US007204883B2

(12) United States Patent
Rizzoli et al.

(10) Patent No.: US 7,204,883 B2
(45) Date of Patent: Apr. 17, 2007

(54) FEED UNIT FOR STRIP WRAPPING MATERIAL

(75) Inventors: Salvatore Rizzoli, Bologna (IT); Fiorenzo Draghetti, Medicina (IT)

(73) Assignee: G.D S.p.A., Bologna (IT)

( * ) Notice: Subject to any disclaimer, the term of this patent is extended or adjusted under 35 U.S.C. 154(b) by 0 days.

(21) Appl. No.: 10/901,193

(22) Filed: Jul. 29, 2004

(65) Prior Publication Data

US 2005/0022730 A1 Feb. 3, 2005

(30) Foreign Application Priority Data

Jul. 29, 2003 (IT) ..... BO2003A0450

(51) Int. Cl.
*B05C 1/06* (2006.01)

(52) U.S. Cl. ..... 118/262; 118/202

(58) Field of Classification Search ..... 118/244, 118/262, 202, 60, 68; 427/207.1, 428.15; 156/578; 165/90; 100/334
See application file for complete search history.

(56) References Cited

U.S. PATENT DOCUMENTS 3,788,271 A * 1/1974 Carpenter et al. ..... 118/33
4,617,864 A * 10/1986 Niedermaier et al. ..... 101/219
6,258,168 B1 7/2001 Pawelko
6,358,318 B1 3/2002 Gherardi
6,506,447 B1 * 1/2003 Hirsch et al. ..... 427/208.4
6,758,906 B2 7/2004 Maiwald

FOREIGN PATENT DOCUMENTS

DE 10019930 10/2001
EP 0791401 8/1997

* cited by examiner

*Primary Examiner*—Brenda A. Lamb
(74) *Attorney, Agent, or Firm*—Timothy J. Klima

(57) ABSTRACT

A strip of wrapping material is advanced by a feed unit that includes a gumming device composed of a gumming roller and a transfer roller contra-rotating about horizontal and parallel axes and in tangential contact one with another along an area coinciding with a straight line generator common to both. At least one of the two rollers is maintained at a given temperature by a fluid directed through a circuit of which a first portion extends along a shaft supporting and driving the roller and a second portion is located internally of the roller itself; the circuit includes valves operating respectively along a flow branch and a return branch of the circuit, associated both with the drive shaft and with the respective roller and interposed between the first and second portions so that these can be opened and closed when required, while the first portion is connected to an inlet duct and to an outlet duct rigidly associated with a frame and connected to the circuit by way of a hydraulic or pneumatic rotary coupling.

4 Claims, 4 Drawing Sheets

FEED UNIT FOR STRIP WRAPPING MATERIAL

BACKGROUND OF THE INVENTION

The present invention relates to a feed unit for strip wrapping material.

The invention is exploitable advantageously for the purpose of applying an adhesive substance to a strip of sheet material as used by machines for the manufacture of tobacco products, the art field to which reference is made explicitly in the following specification albeit with no limitation in general scope implied.

More precisely, the present invention relates to a roller type gumming device utilized in a filter tip attachment to apply a layer of adhesive to a continuous strip of paper, which is then divided into discrete lengths, or single tipping papers, serving ultimately to join together filters and relative cigarette sticks.

The prior art embraces the solution of applying an adhesive to a continuous strip of paper material by means of a gumming device consisting in a pair of rollers contrarotating about horizontal axes and engaging one with another resiliently along an area of mutual contact. One such roller functions as a transfer roller and the other as the gumming roller proper, its surface revolving tangentially to the continuous strip of paper material.

The transfer roller and gumming roller combine to establish a trough between the two mutually opposed portions of their respective revolving cylindrical surfaces converging immediately above the area of mutual contact aforementioned, whilst the space directly above the trough is occupied by the nozzle of a pipeline connected to a tank filled with the adhesive.

The trough extends along the entire straight line generator of contact between the rollers and holds a reserve of the adhesive from which to prime the gumming roller.

The direction of rotation of the gumming roller is such that the layer of adhesive can be applied by the outer cylindrical surface of the selfsame roller to the continuous strip of material at a point downstream of the area along which contact is made with the transfer roller. The thickness of the layer of adhesive is controlled by the pressure of the contact between the two rollers.

It has been found that adhesives of the type in question need to be maintained at a predetermined and substantially constant temperature throughout the gumming process. Should the temperature happen to stray outside well defined limits, in effect, the adhesive will lose its physical and chemical properties such as viscosity, bonding power, etc., and can then no longer be spread uniformly over the strip material.

The object of the present invention is to provide a gumming device unaffected by the aforementioned drawback.

SUMMARY OF THE INVENTION

The stated object is realized according to the present invention in a feed unit for strip wrapping material that comprises a gumming device positioned to act on the strip, and means by which to support the gumming device, wherein the gumming device includes a gumming roller and a transfer roller rotatable about relative horizontal and parallel axes and engaging one with another along an area of tangential contact coinciding with a straight line generator common to the two rollers in such a way as to create a trough between their respective cylindrical surfaces, extending adjacent to the area of tangential contact and serving to hold a predetermined quantity of an adhesive substance.

To advantage, the feed unit comprises a circuit through which to circulate a fluid controlling the temperature at least of the gumming roller or of the transfer roller.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
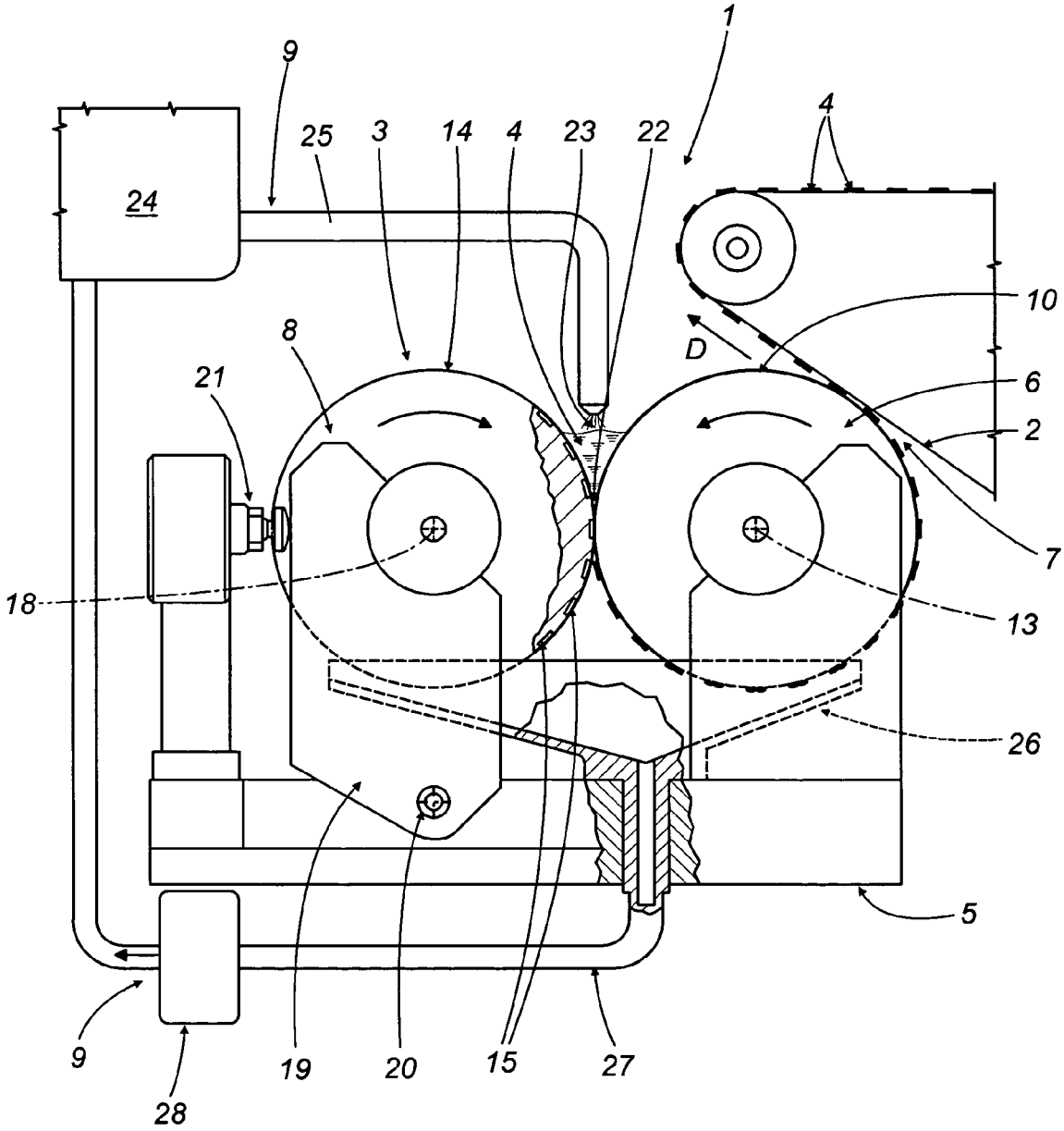
FIG. 1 is a schematic elevation view of a feed unit for strip wrapping material according to the present invention, shown partly in section and with parts omitted for clarity, and illustrated in a first preferred embodiment.
Figure 2:
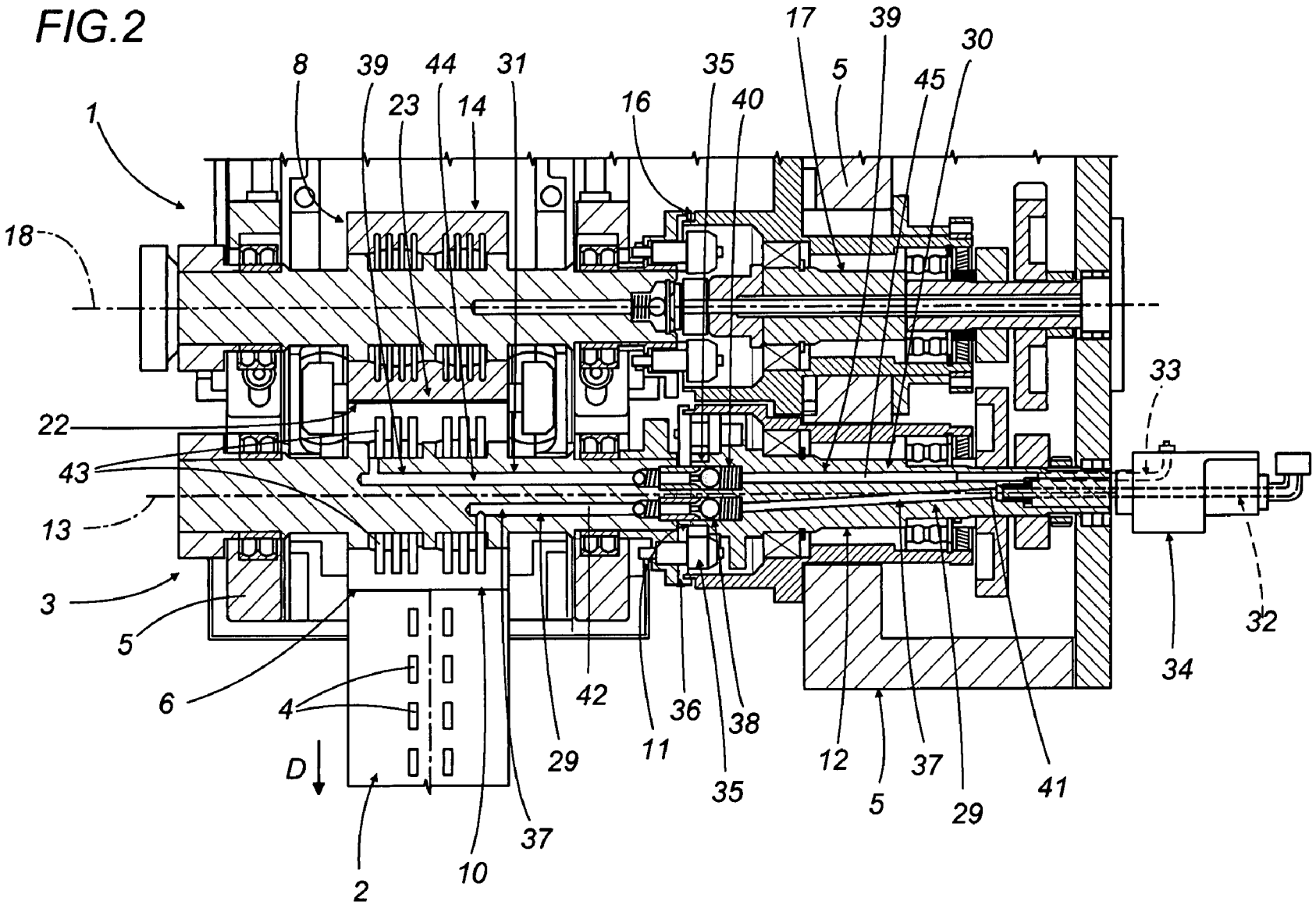
FIGS. 2, 3 and 4 are three schematic plan views showing three different embodiments of the unit in FIG. 1.

Referring to FIGS. 1 and 2 of the accompanying drawings, 1 denotes a feed unit serving to advance a strip 2 of wrapping material along a direction denoted D and including a gumming device, denoted 3 in its entirety, by which an adhesive substance 4 is applied to the advancing strip 2. Thereafter, the strip 2 is taken up by a filter tip attachment and divided into single papers (not illustrated) by means of which to join filters (not illustrated) to relative cigarette sticks (not illustrated).

The gumming device 3, mounted to relative support means consisting in a frame denoted 5, comprises a first gumming roller 6 by which a layer of the adhesive 4 is applied to the strip 2 at a gumming station 7, and a second transfer roller 8 operating in conjunction with the gumming roller 6, by which a given quantity of adhesive 4 is released to the gumming roller 6 for application to the strip 2.

Also forming part of the gumming device 3 is a circuit 9 supplying adhesive 4 continuously to the two rollers 6 and 8.

The gumming roller 6 is delimited outermost by a cylindrical surface 10 revolving tangentially to the advancing strip 2 at the gumming station 7, and cantilevered from the free end 11 of a respective drive shaft 12 rotatable about a horizontal axis 13 and carried by the frame 5.

The gumming roller 6 is driven in rotation by the shaft 12 about the relative axis 13, turning in a counterclockwise direction as viewed in FIG. 1.

As indicated in FIG. 1, the transfer roller 8 is delimited outermost by a cylindrical surface 14 presenting depressions or pockets, denoted 15, and cantilevered from the free end 16 of a respective drive shaft 17 carried together with the roller 8 by the frame 5.

The roller 8 presents a horizontal axis 18 lying parallel with and occupying the same substantially horizontal plane as the axis 13 first mentioned.

With reference to FIG. 1, the gumming roller 6 is set in rotation counterclockwise by the shaft 12 about the relative axis 13, through the agency of drive means not illustrated in the drawings, and the same shaft 12 also causes the transfer roller 8 to rotate together with the relative shaft 17 about the parallel axis 18 through the agency of further drive means, likewise not illustrated, turning clockwise as viewed in FIG. 1 and at a peripheral velocity identical to that of the gumming roller 6.

Again with reference to FIG. 1, the transfer roller 8 is carried together with the shaft 17 on a yoke 19 hinged to the frame 5 by way of a pivot 20 aligned on an axis parallel to the axes 13 and 18 of the rollers, in such a way that it can be made to rock on the frame 5 by an actuator 21 and thus cause the cylindrical surfaces 10 and 14 to engage one with another along an area 22 of tangential contact coinciding with a common straight line generator extending parallel to the axes 13 and 18, thereby establishing a trough 23 of substantially Vee-shaped cross-sectional profile between the two rollers 6 and 8.

Still referring to FIG. 1, the aforementioned circuit 9 supplying the adhesive 4 incorporates a tank 24 with an outlet pipeline 25 that terminates above the trough 23, also a vessel 26 positioned under the rollers 6 and 8 in order to collect the excess adhesive escaping from the free ends of the selfsame rollers.

The vessel 26 connects with a return pipeline 27 through which the adhesive 4 collected beneath the rollers is redirected back to the tank 24 by means of a pump 28.

With reference to FIG. 2, the gumming device 3 is equipped with a circuit 29 containing a fluid by means of which to control the temperature at the cylindrical surface 10 of the gumming roller 6.

In particular, the circuit 29 is split into two portions, respectively a first portion 30 and a second portion 31.

The first portion 30 extends through the shaft 12 supporting and driving the gumming roller 6, whilst the second portion 31 extends through the roller 6 itself.

The circuit 29 communicates by way of the first portion 30 with an inlet duct 32 and with an outlet duct 33, both rigidly associated with the frame 5 and connected to the first portion 30 by means of a hydraulic or pneumatic rotary coupling 34.

Also forming part of the circuit 29 are quick coupler means 35 operating between the free end 11 of the shaft 12 and the relative gumming roller 6, such as will allow the selfsame roller 6 to be separated from the shaft 12 at a relative coupling interface 36.

In particular, the circuit 29 comprises a flow branch 37 extending along the first portion 30 and the second portion 31, internally of the roller 6.

A first valve element 38 incorporated into the circuit 29 operates along the flow branch 37 at the coupling interface 36.

The circuit 29 also comprises a return branch 39 extending along the second portion 31 and along the first portion 30; similarly to the flow branch 37, the return branch 39 incorporates a second valve element 40 operating at the coupling interface 36.

More exactly, the aforementioned flow branch 37 of the circuit 29 departs from the inlet duct 32 and is composed of a first duct 41, extending along the drive shaft 12, also a second duct 42 extending along the gumming roller 6 and incorporating a plurality of annular chambers 43 formed within the roller 6.

The first duct 41 and the second duct 42 are connected one to another at the coupling interface 36 by the first valve element 38.

The return branch 39 of the circuit 29 departs from the annular chambers 43 and includes a third duct 44, extending along the gumming roller 6, also a fourth duct 45 extending along the drive shaft 12 and leading back ultimately to the outlet duct 33.

The third duct 44 and the fourth duct 45 are connected one to another at the coupling interface 36 by the second valve element 40, which is similar to the first.

Whenever the gumming roller 6 is detached from the end 11 of the drive shaft 12 for the purposes of routine or major servicing, such as cleaning of the outer surface 10, the aforementioned first and second valve elements 38 and 40 will shut off and seal the first and second portions 30 and 31 of the circuit 29 at the coupling interface 36.

Figure 3:
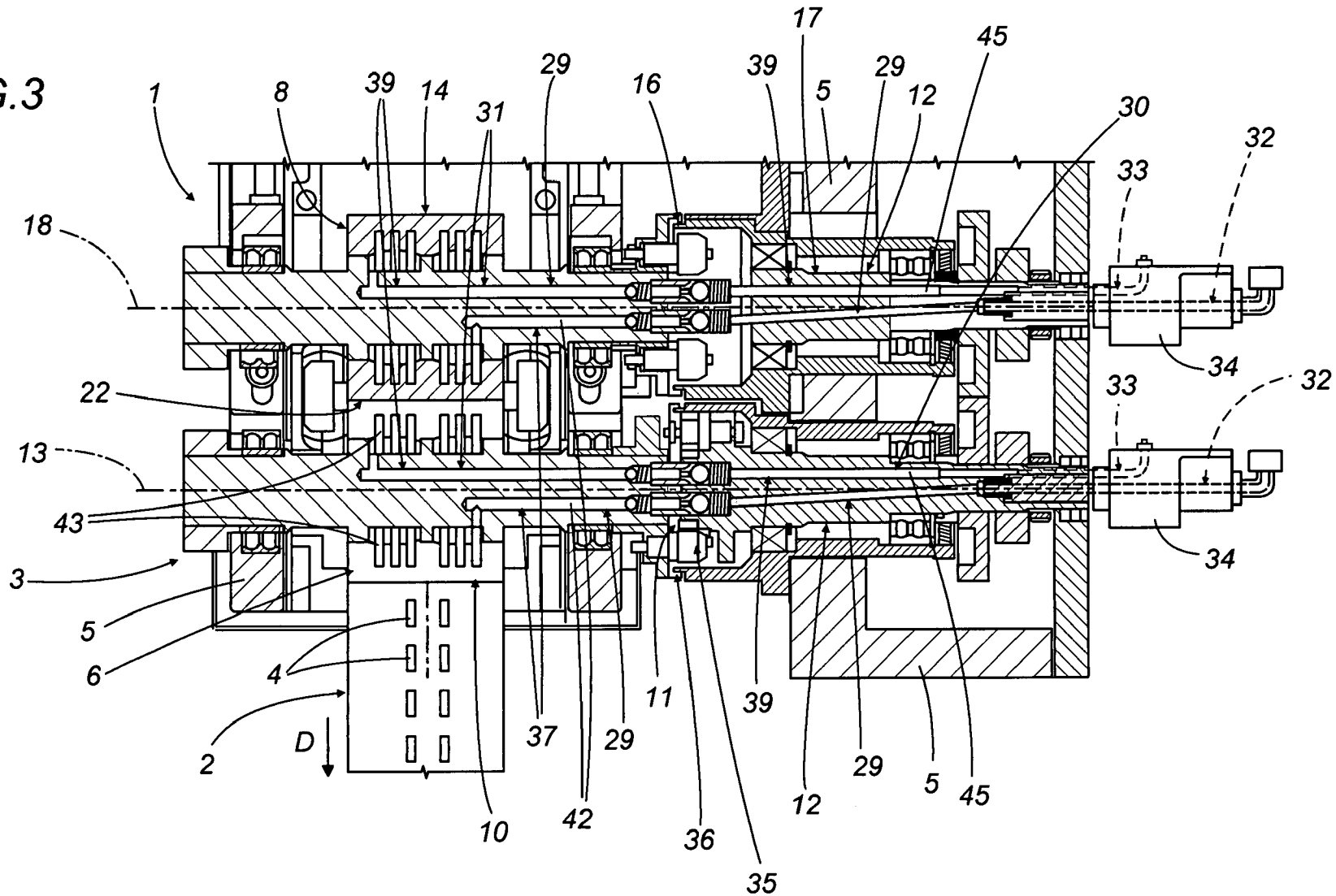

In the example of FIG. 3, which illustrates the transfer roller 8, this same roller is equipped likewise to advantage with a circuit 29 identical to that of the gumming roller 6, serving to control the temperature at the relative outer surface 14.

Similarly, the transfer roller 8 is provided with quick coupler means 35 operating between the free end 16 of the shaft 17 and the roller 8, such as will allow the roller 8 to be separated from the shaft 17 at a relative coupling interface 36.

Figure 4:
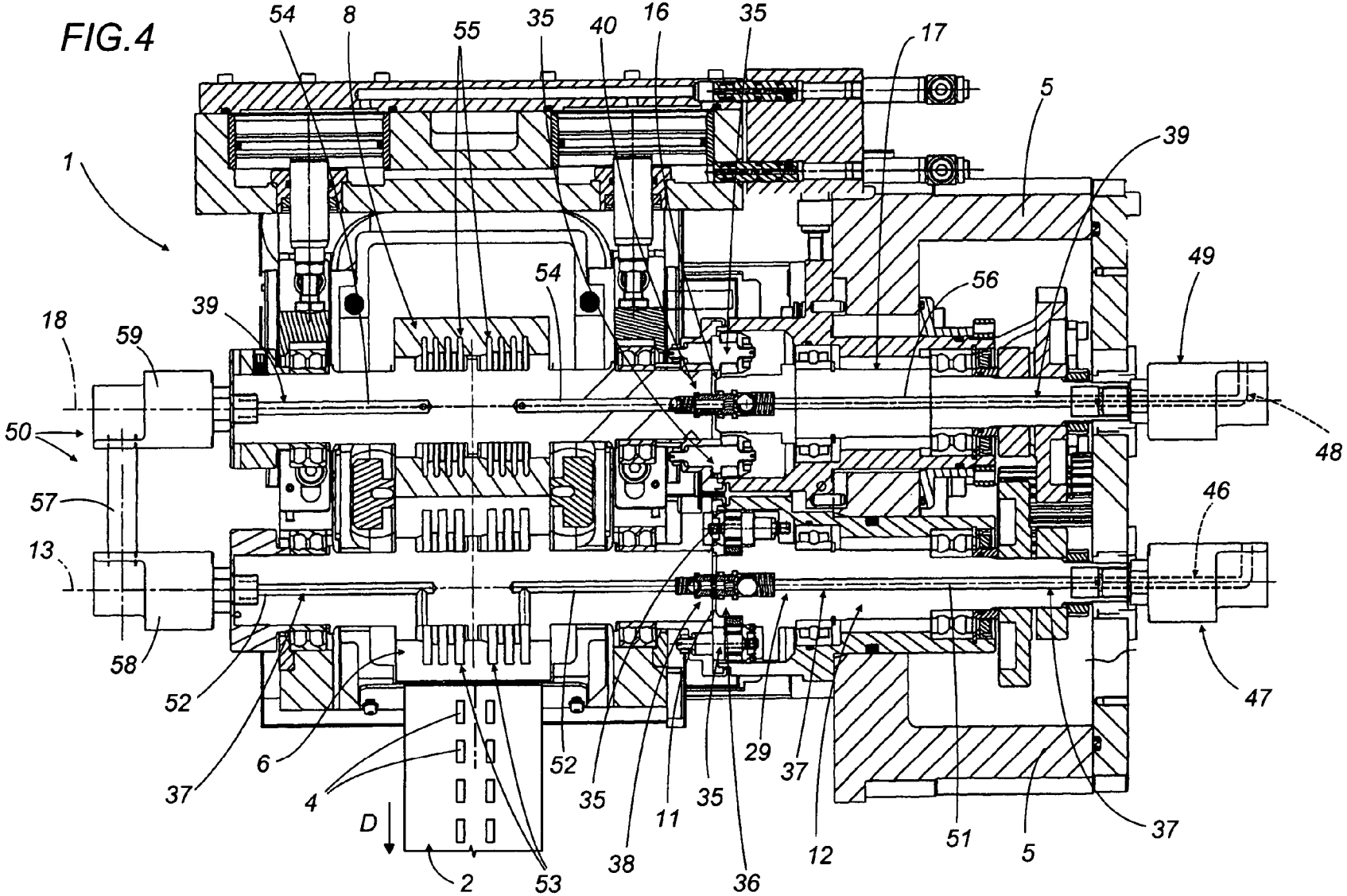

In the embodiment of FIG. 4, the flow branch 37 of the circuit 29 extends from an inlet duct 46, rigidly associated with the frame 5 and connected to the selfsame branch 37 by means of a hydraulic or pneumatic rotary coupling 47, passing through one of the two rollers, which preferably will be the gumming roller 6, whilst the return branch 39 passes through the remaining roller, and more exactly the transfer roller 8, back to an outlet duct 48 associated rigidly with the frame 5 and connected to the selfsame branch 39 by means of a hydraulic or pneumatic rotary coupling 49 identical to the coupling 47 first mentioned. The two flow and return branches 37 and 39 are connected one to another by way of coupling means interposed between the two rollers 6 and 8 and denoted 50 in their entirety, to be described in due course.

More exactly, the flow branch 37 of this second circuit 29 departs from the inlet duct 46 and is composed of a first duct 51, extending along the drive shaft 12, also a second duct 52 extending along the gumming roller 6 and incorporating a plurality of annular chambers 53 formed within the roller 6.

The first duct 51 and the second duct 52 are connected one to another at the coupling interface 36 by the first valve element 38.

The return branch 39 of the circuit 29 departs from the aforementioned coupling means 50 and is composed of a third duct 54, extending along the transfer roller 8 and incorporating a plurality of annular chambers 55, also a fourth duct 56 that extends along the relative drive shaft 17 and back ultimately to the outlet duct 48.

The third duct 54 and the fourth duct 56 are connected one to another at the coupling interface 36 by the second valve element 40, which is similar to the first.

The aforementioned coupling means 50 comprise a fixed duct 57 connected to the outlet of the second duct 52 and the inlet of the third duct 54 by means of respective rotary couplings 58 and 59.

Likewise in this embodiment, whenever the gumming roller 6 needs to be detached from the end 11 of the one shaft 12, or the transfer roller 8 from the end 16 of the other shaft 17, for the purposes of routine or major servicing, typically cleaning, the aforementioned first and second valve elements 38 and 40 will shut off and seal the first and second portions 30 and 31 of the circuit 29 at the coupling interface 36, isolating the first and second ducts 51 and 52 associated with the gumming roller 6 and the third and fourth ducts 54 and 56 associated with the transfer roller 8.

What is claimed is:

1. A feed unit for strip wrapping material comprising:

a gumming device acting on the strip;

means by which to support the gumming device;

a gumming roller and a transfer roller forming part of the gumming device, rotatable about horizontal and parallel axes, each roller being carried and driven by a respective drive shaft, and engaging one with another along an area of tangential contact coinciding with a straight line generator common to the two rollers in such a way as to create a trough between their respective cylindrical surfaces, extending adjacent to the area of tangential contact and serving to hold a predetermined quantity of an adhesive substance;

a circuit, through which to circulate a fluid controlling the temperature of at least the gumming roller or of the transfer roller of the gumming device, said circuit comprising:

an inlet duct and an outlet duct admitting and releasing the fluid, a flow branch, associated with at least one of the two rollers, which departs from the respective inlet duct and passes through a first duct extending along the respective drive shaft, through a first valve element, then through a second duct extending along the roller associated to the drive shaft and including a plurality of annular chambers formed within the selfsame roller, and a return branch which departs from the annular chambers and passes through a third duct extending along the selfsame roller, through a second valve element, then through a fourth duct extending along the selfsame drive shaft and terminating at the outlet duct.

2. A feed unit for strip wrapping material comprising:

a gumming device acting on the strip;

means by which to support the gumming device;

a gumming roller and a transfer roller forming part of the gumming device, rotatable about horizontal and parallel axes, each roller being carried and driven by a respective drive shaft, and engaging one with another along an area of tangential contact coinciding with a straight line generator common to the two rollers in such a way as to create a trough between their respective cylindrical surfaces, extending adjacent to the area of tangential contact and serving to hold a predetermined quantity of an adhesive substance;

a circuit through which to circulate a fluid controlling the temperature of both rollers, of which a first flow branch extends though one of the two rollers and through the respective drive shaft connected to said roller, and a return branch extends through the other of the two rollers and through the relative drive shaft connected to this last roller, wherein the circuit comprises respective ducts and departs from an inlet duct connected to the means of support by way of a first rotary coupling, passing in sequence through the drive shaft of one of the two rollers, through a first valve element, through a plurality of annular chambers located within one of the two rollers, then through coupling means interposed between the two rollers, through a plurality of annular chambers located within the remaining roller, through a second valve element through the relative drive shaft and terminating at an outlet duct connected to the means of support by way of a second rotary coupling.

3. A feed unit for strip wrapping material comprising:

a gumming device acting on the strip;

means by which to support the gumming device;

a gumming roller and a transfer roller forming part of the gumming device, rotatable about horizontal and parallel axes, each roller being carried and driven by a respective drive shaft, and engaging one with another along an area of tangential contact coinciding with a straight line generator common to the two rollers in such a way as to create a trough between their respective cylindrical surfaces, extending adjacent to the area of tangential contact and serving to hold a predetermined quantity of an adhesive substance;

a circuit through which to circulate a fluid controlling the temperature of both rollers, of which a first flow branch extends through one of the two rollers and Through the respective drive shaft connected to said roller, and a return branch extends through the other of the two rollers and through the relative drive shaft connected to this last roller, wherein the circuit comprises respective ducts and departs from an inlet duct connected to the means of support by way of a first rotary coupling, passing in sequence through the drive shaft of one of the two rollers, through a first valve element, through a plurality of annular chambers located within one of the two rollers, then through coupling means interposed between the two rollers, through a plurality of annular chambers located within the remaining roller, through a second valve element, through the relative drive shaft and terminating at an outlet duct connected to the means of support by way of a second rotray coupling, the coupling means comprising a rotary coupling connected to an outlet end of the flow branch leaving one of the two rollers, a rotary coupling connected to an inlet end of the return branch extending along the other roller, and a fixed duct interconnecting the two rotary couplings.

4. A feed unit for strip wrapping material comprising:

a gumming device acting on the strip;

means by which to support the gumming device;

a gumming roller and a transfer roller forming part of the gumming device, rotatable about horizontal and parallel axes and engaging one with another along an area of tangential contact coinciding with a straight line generator common to the two rollers in such a way as to create a trough between their respective cylindrical surfaces, extending adjacent to the area of tangential contact and serving to hold a predetermined quantity of an adhesive substance;

a circuit through which to circulate a fluid controlling the temperature of at least the gumming roller or of the transfer roller of the gumming device, the circuit comprising a plurality of annular chambers located within the respective roller, the circuit comprising a first portion extending along a shaft carrying and driving the respective roller, and a second portion located internally of the selfsame roller, of which the first portion is connected to an inlet duct and an outlet duct admitting and releasing the fluid, the inlet and outlet ducts in their turn being rigidly associated with the means of support and connected to the circuit by way of a hydraulic or pneumatic rotary coupling;

means by which a free end of the drive shaft is coupled to the respective roller in such a manner that the selfsame roller can be separated axially from the shaft, also valve means operating on a flow branch and on a return branch of the circuit, associated with both the drive shaft and the respective roller and interposed between the first and second portions of the circuit in such a way as to allow of closing and opening the selfsame portions, wherein the flow branch of the circuit departs from the inlet duct and passes through a first duct extending along the relative drive shaft, through a first valve element, then through a second duct extending along the roller associated to the drive shaft and including a plurality of annular chambers formed within the selfsame roller, whilst the return branch departs from the annular chambers and passes through a third duct extending along the selfsame roller, through a second valve element, then through a fourth duct extending along the selfsame drive shaft and terminating at the outlet duct.

* * * * *